US010372068B2

(12) United States Patent
Iida

(10) Patent No.: US 10,372,068 B2
(45) Date of Patent: Aug. 6, 2019

(54) DEVELOPMENT DEVICE

(71) Applicant: CANON KABUSHIKI KAISHA, Tokyo (JP)

(72) Inventor: Takanori Iida, Noda (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/803,522

(22) Filed: Nov. 3, 2017

(65) Prior Publication Data

US 2018/0129152 A1 May 10, 2018

(30) Foreign Application Priority Data

Nov. 9, 2016 (JP) ..... 2016-218862

(51) Int. Cl.
*G03G 15/16* (2006.01)
*G03G 15/08* (2006.01)
*G03G 15/09* (2006.01)

(52) U.S. Cl.
CPC ..... *G03G 15/1675* (2013.01); *G03G 15/0844* (2013.01); *G03G 15/0848* (2013.01); *G03G 15/0868* (2013.01); *G03G 15/0893* (2013.01); *G03G 15/0935* (2013.01)

(58) Field of Classification Search
CPC ..... G03G 15/0822; G03G 15/0844
See application file for complete search history.

(56) References Cited

U.S. PATENT DOCUMENTS 8,295,741 B2 * 10/2012 Kido ..... G03G 15/0808 399/222
2009/0214266 A1 * 8/2009 Kato ..... G03G 15/0893 399/254
2014/0112687 A1 * 4/2014 Ohmura ..... G03G 15/0893 399/254

FOREIGN PATENT DOCUMENTS

JP 2016-024353 A 2/2016

* cited by examiner

*Primary Examiner* — Gregory H Curran
(74) *Attorney, Agent, or Firm* — Canon USA, Inc. IP Division

(57) ABSTRACT

A developer circulated between first and second chambers in a function separation type development device including a developer discharge portion is prevented from being excessively discharged from the developer discharge portion. The developer discharge portion is disposed in the first chamber and is provided downstream of a region on a developer bearing member in the direction in which the developer in the first chamber is conveyed, the region corresponding to a maximum image region formable on an image bearing member.

24 Claims, 6 Drawing Sheets

DEVELOPMENT DEVICE

BACKGROUND

Field

The present disclosure generally relates to development devices.

Description of the Related Art

Japanese Patent Application Laid-Open No. 2016-024353 discusses a function separation type development device having the function of supplying a two-component developer (hereinafter, referred to as "developer") containing toner and magnetic carrier to a developer bearing member and the function of collecting the developer from the developer bearing member.

The function separation type development device includes first and second chambers and a partition wall. The first chamber supplies the developer to the developer bearing member. The second chamber collects, from the developer bearing member, the developer having passed through a development region disposed facing the image bearing member. The partition wall partitions the first and second chambers. Further, the partition wall of the function separation type development device is provided with a guiding portion which guides the developer, having passed through the development region and having been removed from the surface of the developer bearing member, by a magnetic field generated by a magnet unit such that the developer is collected into the second chamber.

In the function separation type development device, the developer is conveyed from an upstream side to a downstream side in the direction in which the developer is conveyed by a first conveyance screw disposed in the first chamber, and the developer in the first chamber is supplied to the developer bearing member. Thus, the surface level of the developer in the first chamber is likely to be lower on the downstream side than on the upstream side in the direction in which the first conveyance screw conveys the developer. Further, in the function separation type development device, the developer is conveyed from an upstream side to a downstream side in the direction in which the developer is conveyed by a second conveyance screw disposed in the second chamber, and the developer is collected from the developer bearing member. Thus, the surface level of the developer in the second chamber is likely to be higher on the downstream side than on the upstream side in the direction in which the second conveyance screw conveys the developer.

In a two-component development method, toner is consumed while no magnetic carrier is consumed during the development of an electrostatic latent image formed on the surface of a photosensitive member serving as an image bearing member. As the magnetic carrier is continuously circulated between the first and second chambers, more toner adheres to the surface of the magnetic carrier and more external additive added to the toner is accumulated on the surface of the magnetic carrier, and this leads to the deterioration of the magnetic carrier.

In a case where a magnetic carrier has deteriorated, toner (toner not being charged) resupplied from a developer resupply portion is less likely to be frictionally charged by the magnetic carrier, so the amount of charge of toner per unit mass is likely to be small, leading to a toner charging failure. When a development operation is conducted in the presence of a toner charging failure, the toner can be scattered around the development region facing the photosensitive member and can adhere to an area of the surface of the photosensitive member where no latent image is formed, resulting in a defective image. Thus, deteriorating magnetic carriers circulated between the first and second chambers are desirably replaced sequentially by a fresh magnetic carrier newly supplied from the developer resupply portion in the function separation type development device.

The development device discussed in Japanese Patent Application Laid-Open No. 2016-024353 includes a developer discharge portion disposed downstream of a communication portion, which permits communication of the developer in the second chamber from the second chamber to the first chamber, in the direction in which the second conveyance screw conveys the developer. In the development device, some of the developer is discharged from the developer discharge portion when the amount of developer in the developer container which circulates between the first and second chambers exceeds a predetermined amount and the surface level of the developer on the downstream side in the direction in which the developer is conveyed in the second chamber becomes elevated.

As described above, the surface level of the developer in the second chamber in the function separation type development device is likely to be higher on the downstream side than on the upstream side in the direction in which the developer is conveyed in the second chamber. Thus, in the case where the developer discharge portion is disposed downstream in the direction in which the developer is conveyed in the second chamber as in the development device discussed in Japanese Patent Application Laid-Open No. 2016-024353, although the amount of developer in the developer container which circulates between the first and second chambers is within the predetermined amount, the developer is excessively discharged from the developer discharge portion, since the surface level of the developer on the downstream side in the direction in which the developer is conveyed in the second chamber is high.

Further, as described above, the surface level of the developer in the first chamber in the function separation type development device is likely to be lower on the downstream side than on the upstream side in the direction in which the developer is conveyed in the first chamber. Thus, if the developer circulated between the first and second chambers is excessively discharged from the developer discharge portion as a result of providing the developer discharge portion downstream in the direction in which the developer is conveyed in the second chamber, the amount of developer communicated from the second chamber to the first chamber is decreased, so the surface level of the developer on the downstream side in the direction in which the developer is conveyed in the first chamber is lowered significantly. In such cases, the amount of developer supplied to the developer bearing member on the downstream side in the direction in which the developer is conveyed in the first chamber is likely to be small, and the amount of developer borne on the developer bearing member varies along the longitudinal direction of the developer bearing member, so an output image can have a non-uniform density. This becomes a significant problem especially in a case where the amount of developer contained in the developer container in the function separation type development device is reduced and an image having a high image ratio is formed.

Thus, there are demands for a new arrangement that prevents the developer circulated between the first and second chambers from being excessively discharged from the developer discharge portion in the function separation type development device including the developer discharge portion.

SUMMARY

Aspects of the present invention are directed to a function separation type development device including a developer discharge portion in which a developer circulated between first and second chambers is prevented from being excessively discharged from the developer discharge portion.

According to an aspect of the present invention, a development device includes a developer bearing member provided rotatably and configured to bear developer containing toner and carrier to convey the developer to a development region facing an image bearing member, a first chamber disposed below a rotation axis line of the developer bearing member in a vertical direction and configured to supply the developer to the developer bearing member, a second chamber disposed to face the developer bearing member and configured to collect from the developer bearing member the developer having passed through the development region, a first conveyance portion disposed in the first chamber and configured to convey the developer in the first chamber in a first conveyance direction, a second conveyance portion disposed in the second chamber and configured to convey the developer in the second chamber in a second conveyance direction opposite to the first conveyance direction, a partition wall configured to partition the first chamber and the second chamber and including a guiding portion configured to guide the developer having passed through the development region to collect the developer from the developer bearing member into the second chamber, a first communication portion configured to permit the developer in the second chamber to be communicated from the second chamber to the first chamber, a second communication portion configured to permit the developer in the first chamber to be communicated from the first chamber to the second chamber, the developer being circulatable between the first chamber and the second chamber through the first communication portion and the second communication portion, a developer resupply portion configured to resupply the developer, and a developer discharge portion configured to discharge some of the developer, wherein the developer discharge portion is disposed in the first chamber and is provided downstream of a region on the developer bearing member in the first conveyance direction, the region corresponding to a maximum image region formable on the image bearing member.

Further features of aspects of the present invention will become apparent from the following description of exemplary embodiments with reference to the attached drawings.

DESCRIPTION OF THE EMBODIMENTS

Various exemplary embodiments of aspects of the present invention will be described below with reference to the attached drawings. It should be noted that the exemplary embodiments described below are not intended to limit the scope of the claimed invention and not all combinations of features described in the exemplary embodiments are necessarily essential to the technical solution of the invention. Exemplary embodiments of aspects of the present invention are applicable to various applications such as printers, various printing machines, copying machines, facsimile machines, multi-functional peripherals, etc.

(Structure of Image Forming Unit)

First, a structure of an image forming unit according to a first exemplary embodiment will be described below with reference to a cross-sectional view illustrated in FIG. 1.

Figure 1:
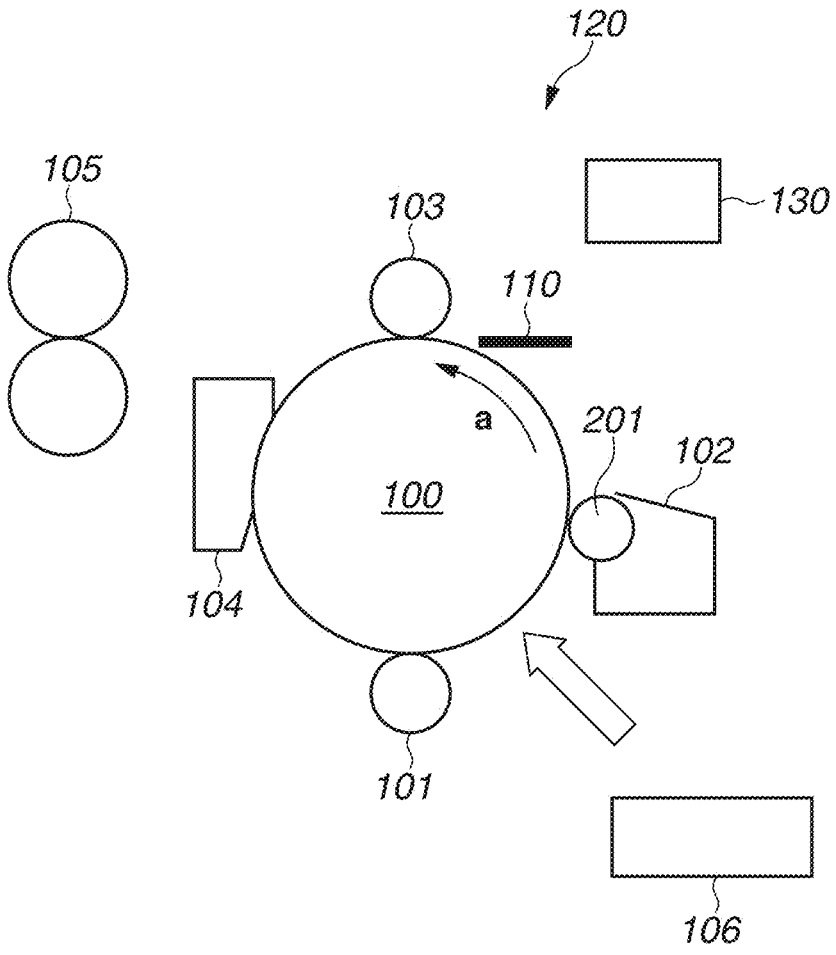
FIG. 1 is a cross sectional view illustrating a structure of an image forming unit.

An example in FIG. 1 illustrates an image forming apparatus 120 employing a combination of a single-drum type, a direct transfer method, and a monochrome printer. The image forming apparatus 120 includes an image forming unit for forming images (toner images).

The image forming unit includes a photosensitive drum 100, which is a rotatable image bearing member. The photosensitive drum 100 is driven and rotated in a rotation direction at predetermined processing speed. While the photosensitive drum 100 according to the first exemplary embodiment is described as a drum-shaped photosensitive member as an example, the photosensitive drum 100 can be a belt-shaped photosensitive member. Around the photosensitive drum 100 are disposed a charging device 101 as a charging unit, an exposure device 106 as a latent image forming unit, and a development device 102 as a development unit in the direction in which the photosensitive drum 100 is rotated (direction of an arrow (a) specified in FIG. 1).

Further, a transfer roller 103 as a transfer unit which forms a transfer area together with the photosensitive drum 100, a photosensitive cleaner 104 for collecting residual toner which is not transferred onto a recording material 110 and remains on the surface of the photosensitive drum 100, and a fixing device 105 as a fixing unit are disposed.

A developer resupply container 130 (also referred to as "toner bottle") for resupplying to the development device 102 a two-component developer (hereinafter, referred to as "developer") containing a magnetic carrier and non-magnetic toner (hereinafter, referred to as "toner") is attached to the image forming apparatus 120. The developer resupply container 130 is attachable to and detachable from the image forming apparatus 120. Further, the development device 102 is attachable to and detachable from the image forming apparatus 120. According to the first exemplary embodiment, the weight percent of the toner with respect to the weight of the developer supplied from the developer resupply container 130 to the development device 102 is, for example, 90% (at this time, the weight percent of the magnetic carrier is 10%).

The photosensitive drum 100 includes a negatively-charged photosensitive layer formed on the outer surface of an aluminum cylinder. The charging device 101 uniformly charges the surface of the photosensitive drum 100 to a negative dark potential Vd [V]. Then, the exposure device 106 scans a laser beam with a rotary mirror to write an electrostatic image (electrostatic latent image) on the charged surface of the photosensitive drum 100. The development device 102 develops the electrostatic latent image with the developer borne on a maximum image region of a development sleeve 201, which is a developer bearing member, and forms a toner image on the surface of the photosensitive drum 100. The maximum image region of the development sleeve 201 is a region corresponding to a maximum region (maximum image region) of an electrostatic latent image formable on the surface of the photosensitive drum 100.

Then, the toner image formed on the surface of the photosensitive drum 100 is transferred onto a recording material 110 conveyed to a transfer nip area by the transfer roller 103. The recording material 110 is, for example, a sheet such as paper or transparent film. The toner that is not transferred onto the recording material 110 and remains on the photosensitive drum 100 is removed by the photosensitive cleaner 104. The toner (waste toner) removed by the photosensitive cleaner 104 is collected into a toner collection container through a waste toner conveyance path. The toner collection container is attachable to and detachable from the image forming apparatus 120 and is disposed on the front side of the image forming apparatus 120 so that a user (serviceman) can replace the toner collection container with ease.

The recording material 110 with the toner image transferred onto the surface of the recording material 110 at the transfer nip area is conveyed to the fixing device 105 and is heated and pressed at the fixing device 105. Consequently, the toner image is fixed onto the surface of the recording material 110. The recording material 110 with the toner image fixed thereon is discharged to a sheet discharge tray.

While the image forming apparatus of the combination of the single-drum type, the direct transfer method, and the monochrome printer is described above as an example of the image forming apparatus 120 with reference to FIG. 1, the image forming apparatus 120 is not limited to the above-described example. According to the first exemplary embodiment, the image forming apparatus 120 can be an image forming apparatus employing any combination of a single-drum type/tandem type, a direct transfer method/intermediate transfer method, and a full-color printer/monochrome printer. Further, the charging method, development method, transfer method, cleaning method, and fixing method of the image forming apparatus 120 according to the first exemplary embodiment are not limited to the methods described above.

For example, in a case where the image forming apparatus 120 is an image forming apparatus employing a combination of a tandem-type, an intermediate transfer method, and a full-color printer, the image forming apparatus 120 includes four image forming units corresponding to yellow (Y), magenta (M), cyan (C), and black (Bk) and further includes four developer containers for resupply which correspond to Y, M, C, and Bk. Further, the image forming apparatus 120 includes an intermediate transfer belt, and a toner image formed on the surface of the photosensitive drum 100 is first transferred onto the intermediate transfer belt and then the toner image on the intermediate transfer belt is transferred onto a recording material.

(Reference Example of Function Separation Type Development Device)

Figure 2:
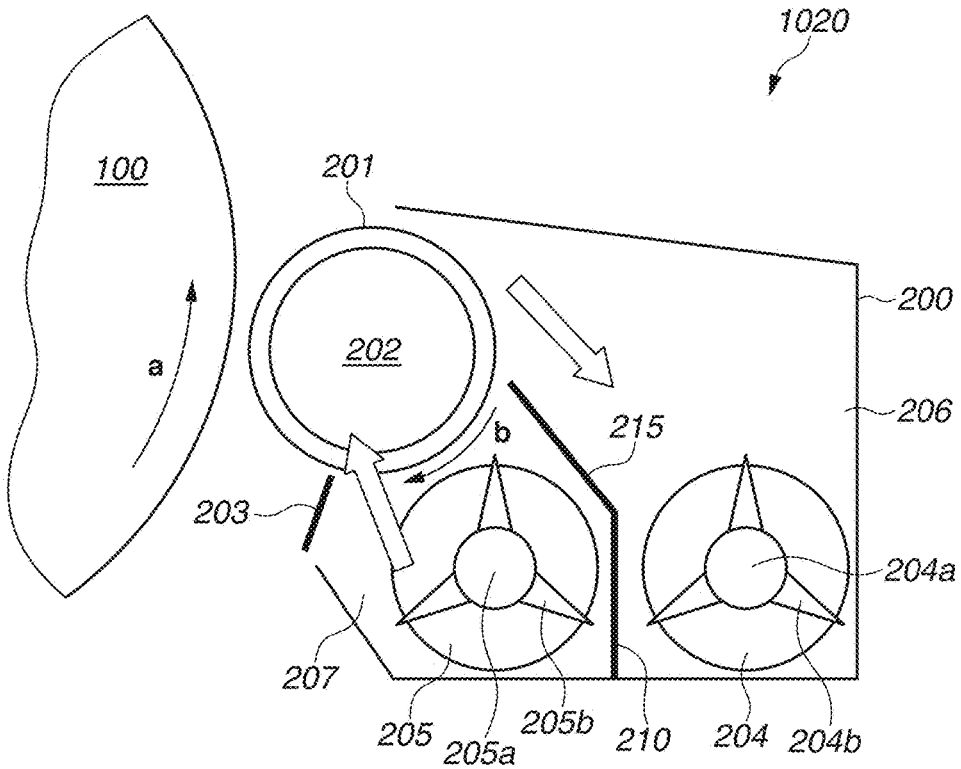
FIG. 2 is a cross sectional view illustrating a structure of a function separation type development device.
Figure 3:
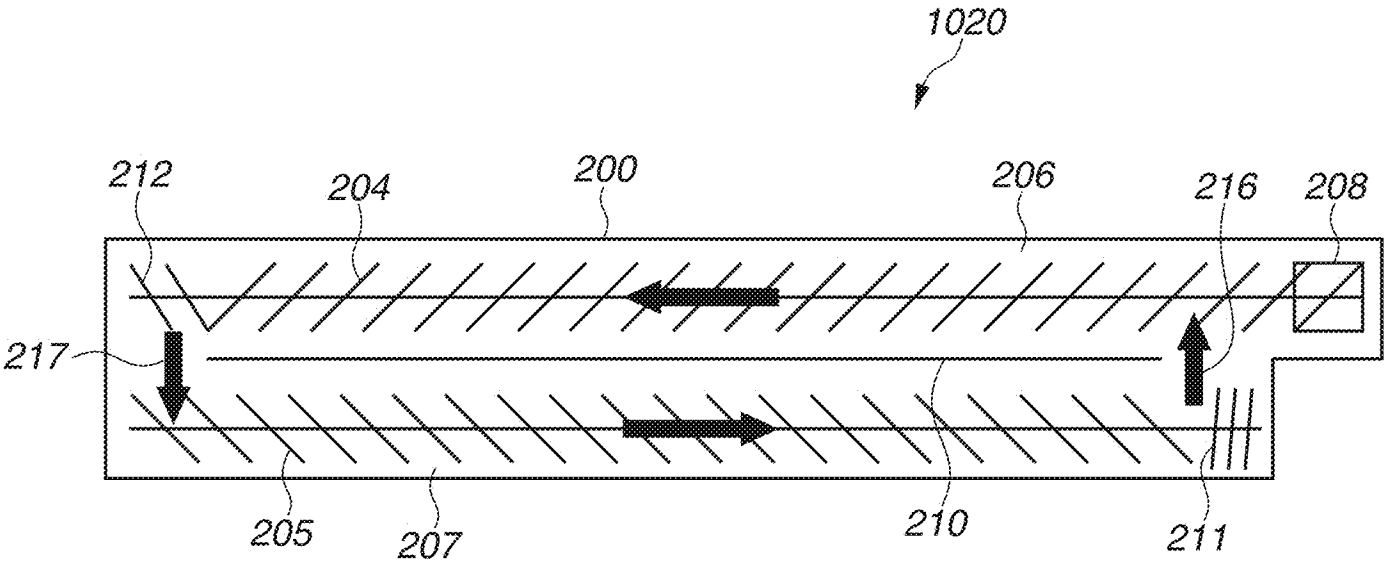
FIG. 3 is a schematic diagram illustrating a structure of the function separation type development device.

The development device 102 according to the first exemplary embodiment is a function separation type development device in which the function of supplying the developer to the development sleeve 201 (hereinafter, referred to as "supply mechanism") and the function of collecting the developer from the development sleeve 201 (hereinafter, referred to as "collection mechanism") are separated. Prior to the description of the development device 102 according to the first exemplary embodiment, the structure of the function separation type development device will be described below with reference to a cross sectional view illustrated in FIG. 2 and a schematic view illustrated in FIG. 3. FIG. 2 is a cross sectional view illustrating a development device 1020 (function separation type development device) along a cross section orthogonal to a rotation axis of the development sleeve 201. FIG. 3 is a top view (schematic view) of the development device 1020 illustrated in FIG. 2.

The development device 1020 is attachable to and detachable from the image forming apparatus 120. The development device 1020 includes a developer container 200 which stores the developer containing the magnetic carrier and the toner. The toner is negatively charged and the magnetic carrier is positively charged by frictional charging.

The toner contains coloration resin particles, which contain a binder resin, a colorant, and other additives as needed, and coloration particles to which an external additive such as a fine colloidal silica powder is added. Further, the toner is a negatively charged polyester resin, and the volume average particle diameter of the toner is desirably 5 [μm] or greater and 8 [μm] or smaller. In the development device 102 according to the first exemplary embodiment, the volume average particle diameter of the toner is 7 [μm].

As to the magnetic carrier, for example, metals such as surface-oxidized iron, surface-unoxidized iron, nickel, cobalt, manganese, chromium, and rear earth metals, alloys thereof, or ferrite oxide are suitable for use, and methods of producing the magnetic particles are not limited to a specific method. Further, the volume average particle diameter of the magnetic carrier is 20 [μm] to 50 [μm], desirably 30 [μm] to 40 [μm], and the resistivity of the magnetic carrier is $10^5$ [Ωm] or higher, desirably $10^6$ [Ωm] or higher. In the development device 102 according to the first exemplary embodiment, a magnetic carrier having a volume average particle diameter of 40 [μm], a resistivity of $5\times10^5$ [Ωm], and an amount of magnetization of 0.31 [$Wb/m^2$] under a magnetic field of 100 [mT] is used.

The developer container 200 includes the development sleeve 201 as the developer bearing member. Inside the development sleeve 201, a magnetic roller (magnet) 202 serving as a magnetic field generation member including a plurality of magnetic poles is fixed and disposed along the circumferential direction of the development sleeve 201. The plurality of magnetic poles of the magnetic roller 202 includes a first magnetic pole and a second magnetic pole having the same polarity as the first magnetic pole and disposed immediately downstream of the first magnetic pole in the direction in which the development sleeve 201 is rotated.

Further, the developer container 200 includes an opening portion at a position corresponding to the development region facing the photosensitive drum 100. The development sleeve 201 is disposed with respect to the developer container 200 so as to be rotatable at a position facing the photosensitive drum 100 such that a portion of the development sleeve 201 is exposed from the opening portion of the developer container 200. The development sleeve 201 is made of a non-magnetic material, such as stainless steel (SUS) or aluminum, and during the development operation, the development sleeve 201 is rotated in the direction of an arrow (b) specified in FIG. 2. In the development device 102 according to the first exemplary embodiment, the diameter of the development sleeve 201 is 20 [mm], and the surface of the development sleeve 201 is rotated at 550 [rpm] along the outer periphery of the magnetic roller 202.

The inside of the developer container 200 is divided into a development chamber 207 and an agitation chamber 206 by a partition wall 210 extending vertically. As illustrated in FIG. 2, the development chamber 207 and the agitation chamber 206 are disposed next to each other in the horizontal direction. Further, as illustrated in FIG. 2, the development chamber 207 is disposed below the development sleeve 201 in the direction of gravity, and the agitation chamber 206 is disposed to face the development sleeve 201.

The partition wall 210 is provided with a guiding portion 215 which guides the developer removed from the development sleeve 201 during the development (the developer having passed through the development region and removed by a magnetic field generated by the magnetic roller 202) such that the developer is directly collected into the agitation chamber 206. The guiding portion 215 includes an inclined surface formed to slope with respect to the bottom surface of the developer container 200 when the development device 1020 is attached to the image forming apparatus 120. The leading end of the guiding portion 215 that faces the development sleeve 201 is not in contact with the surface of the development sleeve 201.

In the development chamber 207, a first screw portion 205 is disposed substantially parallel along the longitudinal direction (direction of rotation axis) of the development sleeve 201. The first screw portion 205 is a rotatable developer conveyance member which agitates and conveys the developer in the development chamber 207. The first screw portion 205 includes a rotation shaft 205*a* and a blade portion 205*b*. The rotation shaft 205*a* is a magnetic member serving as a rotatable shaft portion extending substantially across the entire region in the longitudinal direction of the development chamber 207. The blade portion 205*b* is a spiral blade portion serving as a developer conveyance portion provided along the outer periphery of the rotation shaft 205*a*. In the development device 102 according to the first exemplary embodiment, the rotation speed of the first screw portion 205 is 800 [rpm], the pitch of the first screw portion 205 is 30 [mm], and the diameter of the outer periphery of the first screw portion 205 is 20 [mm]. The phrase "the pitch of the first screw portion 205 is 30 [mm]" indicates that the blade portion 205*b* forms a spiral structure around the rotation shaft 205*a* at a pitch of 30 [mm].

Further, the agitation chamber 206 includes a second screw portion 204 as a rotatable developer conveyance member which agitates the developer in the agitation chamber 206 and conveys the developer in an opposite direction to the direction in which the first screw portion 205 conveys the developer. The second screw portion 204 is disposed substantially parallel along the longitudinal direction (direction of rotation axis) of the development sleeve 201. The second screw portion 204 includes a rotation shaft 204*a* and a blade portion 204*b*. The rotation shaft 204*a* is a magnetic member serving as a rotatable shaft portion extending substantially across the entire region in the longitudinal direction of the agitation chamber 206. The blade portion 204*b* is a spiral blade portion serving as a developer conveyance portion provided along the outer periphery of the rotation shaft 204*a*. In the development device 102 according to the first exemplary embodiment, the rotation speed of the second screw portion 204 is 800 [rpm], the pitch of the second screw portion 204 is 30 [mm], and the diameter of the outer periphery of the second screw portion 204 is 20 [mm]. The phrase "the pitch of the second screw portion 204 is 30 [mm]" indicates that the blade portion 204*b* forms a spiral structure around the rotation shaft 204*a* at a pitch of 30 [mm].

Further, the developer container 200 includes a development blade 203 as a developer regulation member which forms a thin layer of the developer on the surface of the development sleeve 201. In the development device 102 according to the first exemplary embodiment, the development blade 203 is disposed such that the nearest point is disposed with a distance of 350 [μm] from the development sleeve 201.

A predetermined amount of the developer supplied to the development sleeve 201 is borne on the surface of the development sleeve 201 by a magnetic field generated by the magnetic roller 202 to form a developer pool. As the development sleeve 201 is rotated, the developer on the surface of the development sleeve 201 is passed through the developer pool so that the layer thickness is regulated by the development blade 203, and the developer is conveyed to the development region facing the photosensitive drum 100. Then, the developer on the surface of the development sleeve 201 is napped on the development region to form a magnetic brush.

Then, the magnetic brush formed on the development region is brought into contact with the photosensitive drum 100 to supply the toner contained in the developer borne on the surface of the development sleeve 201 to the photosensitive drum 100 so that the electrostatic latent image on the surface of the photosensitive drum 100 is developed into a toner image. At this time, in general, a development bias with an alternating-current component superimposed on a predetermined direct-current component $V_{dev}$ [V] is applied to the development sleeve 201 to improve the rate of toner attached to the electrostatic latent image (development efficiency). In the development device 102 according to the first exemplary embodiment, the alternating-current component of the development bias is a rectangular wave, the frequency is 7 [kHz], and the peak-to-peak voltage is 1.3 [kV].

As the development sleeve 201 is rotated, the residual developer on the surface of the development sleeve 201 that remains after the toner is supplied to the photosensitive drum 100 receives a magnetic repulsion force from a repulsive magnetic field of equal polarity generated by the magnetic roller 202, and the residual developer is removed from the surface of the development sleeve 201. Then, the developer removed from the development sleeve 201 falls onto the inclined surface of the guiding portion 215. Thereafter, the developer removed from the development sleeve 201 is slid down the inclined surface of the guiding portion 215 by the gravity and then falls into the agitation chamber 206 so that the developer is collected into the agitation chamber 206.

As described above, in the function separation type development device, the developer removed from the surface of the development sleeve 201 during the development (developer having passed through the development region and removed by a magnetic field generated by the magnetic roller 202) is not collected into the development chamber 207 but collected directly into the agitation chamber 206. Since the developer removed from the surface of the development sleeve 201 during the development (developer having passed through the development region and removed by a magnetic field generated by the magnetic roller 202) is collected in the agitation chamber 206 as described above, the agitation chamber 206 is also referred to as a collection chamber. Further, the developer in the development chamber 207 is supplied to the development sleeve 201 by the first screw portion 205. Since the developer is supplied from the development chamber 207 to the development sleeve 201 as described above, the development chamber 207 is also referred to as a supply chamber. The function separation type development device includes paths from the upstream side to the downstream side in the direction in which the developer is conveyed in the agitation chamber 206. Through one of the paths, the developer is conveyed by the second screw portion 204. Through the other one of the paths, the developer removed from the development sleeve 201 is conveyed to the agitation chamber 206 through the guiding portion 215.

As illustrated in FIG. 3, one end portion of the partition wall 210 in the longitudinal direction of the partition wall 210 includes a first communication opening 216 as a developer passing portion (communication portion) for passing the developer from the development chamber 207 to the agitation chamber 206. Specifically, the developer is communicable from the development chamber 207 to the agitation chamber 206 through the first communication opening 216. Further, the other end portion of the partition wall 210 in the longitudinal direction of the partition wall 210 includes a second communication opening 217 as a developer passing portion (communication portion) for passing the developer from the agitation chamber 206 to the development chamber 207. Specifically, the developer is communicable from the agitation chamber 206 to the development chamber 207 through the second communication opening 217.

The developer in the development chamber 207 is conveyed by the first screw portion 205 from the upstream side to the downstream side in the direction in which the developer is conveyed. Further, the developer in the agitation chamber 206 is conveyed by the second screw portion 204 from the upstream side to the downstream side in the direction in which the developer is conveyed. In this way, the first screw portion 205 and the second screw portion 204 convey the developer in opposite directions along the longitudinal direction (direction of rotation axis) of the development sleeve 201. Then, a flow of developer conveyed by the first screw portion 205 and a flow of developer conveyed by the second screw portion 204 through the first communication opening 216 and the second communication opening 217 are formed. Specifically, the developer from the development chamber 207 to the agitation chamber 206 is passed through the first communication opening 216, and the developer from the agitation chamber 206 to the development chamber 207 is passed through the second communication opening 217.

As illustrated in FIG. 3, a first returning screw portion 211 is disposed downstream (i.e., near the first communication opening 216) of the most upstream portion of a facing portion of the rotation shaft 205*a* that faces the first communication opening 216 in the direction in which the first screw portion 205 conveys the developer.

The first returning screw portion 211 includes a spiral blade portion provided to the outer periphery of the rotation shaft 205*a* and conveys the developer contained in the development chamber 207 in the opposite direction to the direction in which the first screw portion 205 conveys the developer. Then, the flow of the developer conveyed by the first screw portion 205 and the flow of the developer conveyed by the first returning screw portion 211 collide to generate a flow toward the first communication opening 216. As the rotation shaft 205*a* is driven and rotated, the developer that is in contact with a portion where the blade portion 205*b* of the first screw portion 205 is replaced by the blade portion of the first returning screw portion 211 is thrown to be conveyed toward the agitation chamber 206. In this way, the developer is passed from the development chamber 207 to the agitation chamber 206 more efficiently.

Further, as illustrated in FIG. 3, a second returning screw portion 212 is provided downstream (i.e., near the second communication opening 217) of the most upstream portion of a facing portion of the rotation shaft 204*a* that faces the second communication opening 217 in the direction in which the second screw portion 204 conveys the developer.

The second returning screw portion 212 includes a spiral blade portion provided to the outer periphery of the rotation shaft 204*a* and conveys the developer contained in the agitation chamber 206 in the opposite direction to the direction in which the second screw portion 204 conveys the developer. Then, the flow of the developer conveyed by the second screw portion 204 and the flow of the developer conveyed by the second returning screw portion 212 collide to generate a flow toward the second communication opening 217. As the rotation shaft 204*a* is driven and rotated, the developer that is in contact with a portion where the blade portion 204*b* of the second screw portion 204 is replaced by the blade portion of the second returning screw portion 212 is thrown to be conveyed toward the development chamber 207. In this way, the developer is passed from the agitation chamber 206 to the development chamber 207 more efficiently.

Further, the developer resupply container 130 for resupplying the developer containing the magnetic carrier and the toner to the development device 102 is in communication with a developer resupply mechanism (hopper) for resupplying the developer to the developer container 200. The hopper includes a hopper screw capable of conveying a predetermined amount of developer, and the hopper is in communication with a developer resupply opening 208 serving as the developer resupply portion in the developer container 200. The resupply of the developer from the hopper to the developer container 200 is conducted by automatic toner resupply control (auto toner replenisher (ATR)). The automatic toner resupply control is for determining the amount of developer to be resupplied to the developer container 200 based on the image ratio at the time of image forming, a result of detection by a toner density sensor provided in the agitation chamber 206, and a result of density detection of a patch image formed on the photosensitive drum 100 or the intermediate transfer belt. For example, the average magnetic permeability of the developer is detected with an inductance sensor as the toner density sensor, and the weight percent of the toner contained in the developer circulated in the developer container 200 is calculated from the detected value to determine the amount of developer to be resupplied to the developer container 200.

The resupply of developer to the developer container 200 is conducted by rotating the hopper screw to convey the developer for resupply contained in the hopper to the developer resupply opening 208. The developer for resupply that is resupplied from the developer resupply opening 208 into the developer container 200 is conveyed by the second screw portion 204 while being agitated together with the developer circulated in the developer container 200.

From the developer resupply opening 208 the toner not being charged is resupplied to the developer container 200. Then, the toner resupplied from the developer resupply opening 208 receives an agitation force from the second screw portion 204 to be brought into contact with the magnetic carrier contained in the developer in the agitation chamber 206 and is frictionally charged. The frictional charging negatively charges the toner and positively charges the magnetic carrier. The frictionally-charged toner adheres to and is held on the surface of the magnetic carrier by electrostatic force. In this way, the toner resupplied from the developer resupply opening 208 to the developer container 200 is held on the magnetic carrier to make the toner density of the developer in the agitation chamber 206 uniform.

During the development of the electrostatic latent image formed on the surface of the photosensitive drum 100, the toner contained in the developer in the development chamber 207 is consumed while the magnetic carrier contained in the developer in the development chamber 207 is not consumed. Thus, as the developer is conveyed from the upstream side toward the downstream side in the direction in which the developer is conveyed in the development chamber 207, the toner density of the developer in the development chamber 207 decreases. Then, the developer with the decreased toner density in the development chamber 207 is conveyed by the first screw portion 205 to the most downstream portion in the direction in which the developer is conveyed in the development chamber 207. Therefore, the developer passed from the development chamber 207 to the agitation chamber 206 through the first communication opening 216 has a decreased density of toner in the developer.

Thus, the toner (toner not being charged) contained in the developer resupplied from the developer resupply opening 208 is desirably agitated sufficiently with the developer (developer having low toner density) passed from the development chamber 207 to the agitation chamber 206 through the first communication opening 216. Hence, the zone in which the toner contained in the developer resupplied from the developer resupply opening 208 is agitated in the agitation chamber 206 is set to the longest possible length. In the development device 102 according to the first exemplary embodiment, the developer resupply opening 208 is disposed upstream of the facing portion of the rotation shaft 204*a* that faces the first communication opening 216 in the direction in which the second screw portion 204 conveys the developer. For example, as illustrated in FIG. 3, the developer resupply opening 208 serving as the developer resupply portion for resupplying the developer to the developer container 200 is formed 30 mm upstream of the most upstream portion of the agitation chamber 206 in the direction in which the second screw portion 204 conveys the developer.

As described above, the toner is consumed while the magnetic carrier is not consumed during the development of the electrostatic latent image formed on the surface of the photosensitive drum 100. In the function separation type development device, the magnetic carrier contained in the developer supplied from the development chamber 207 to the development sleeve 201 to coat the surface of the development sleeve 201 undergoes the development and is then removed from the surface of the development sleeve 201. The magnetic carrier removed from the surface of the development sleeve 201 falls onto the agitation chamber 206 and is collected. Then, the magnetic carrier collected in the agitation chamber 206 is conveyed in the agitation chamber 206 by the second screw portion 204 and thereafter conveyed in the development chamber 207 by the first screw portion 205. In the function separation type development device, as the magnetic carrier is circulated between the agitation chamber 206 and the development chamber 207 as described above, more toner adheres to the surface of the magnetic carrier and more external additive added to the toner is accumulated on the surface of the magnetic carrier, and this leads to the deterioration of the magnetic carrier.

In a case where the magnetic carrier has deteriorated, the toner (toner not being charged) resupplied from the developer resupply opening 208 is less likely to be frictionally charged by the magnetic carrier, so the amount of charge of toner per unit mass is likely to be small, leading to a toner charging failure. When a development operation is conducted in the presence of a toner charging failure, the toner can be scattered around the development region facing the photosensitive drum 100 and can adhere to an area of the surface of the photosensitive drum 100 where no latent image is formed, resulting in a defective image. Thus, the deteriorating magnetic carriers circulated between the agitation chamber 206 and the development chamber 207 are desirably replaced sequentially by a fresh magnetic carrier newly resupplied from the developer resupply opening 208 in the function separation type development device.

In the function separation type development device, the surface level of the developer in the agitation chamber 206 is likely to be higher on the downstream side than on the upstream side in the direction in which the developer is conveyed in the agitation chamber 206. For example, assume a case where the developer discharge portion is disposed downstream in the direction in which the developer is conveyed in the agitation chamber 206 in the function separation type development device. In such a case, although the amount of developer in the developer container 200 which circulates between the agitation chamber 206 and the development chamber 207 is within the predetermined amount, since the surface level of the developer on the downstream side in the direction in which the developer is conveyed in the agitation chamber 206 is high, the developer is excessively discharged from the developer discharge portion. Thus, in the function separation type development device, the developer discharge portion is desirably disposed in the development chamber 207 instead of the agitation chamber 206.

Further, the surface level of the developer in the development chamber 207 in the function separation type development device is likely to be higher on the upstream side than on the downstream side in the direction in which the developer is conveyed in the development chamber 207. For example, assume a case where the developer discharge portion is disposed upstream in the direction in which the developer is conveyed in the development chamber 207 in the function separation type development device. In such a case, although the amount of developer in the developer container 200 which circulates between the agitation chamber 206 and the development chamber 207 is within the predetermined amount, since the surface level of the developer on the upstream side in the direction in which the developer is conveyed in the development chamber 207 is high, the developer is excessively discharged from the developer discharge portion.

According to the first exemplary embodiment, the developer discharge portion is provided on the downstream side instead of the upstream side in the direction in which the developer is conveyed in the development chamber 207 in the function separation type development device. In this way, the developer circulated between the agitation chamber 206 and the supply chamber is prevented from being excessively discharged from the developer discharge portion in the function separation type development device including the developer discharge portion.

(Development Device According to First Exemplary Embodiment)

Figure 4:
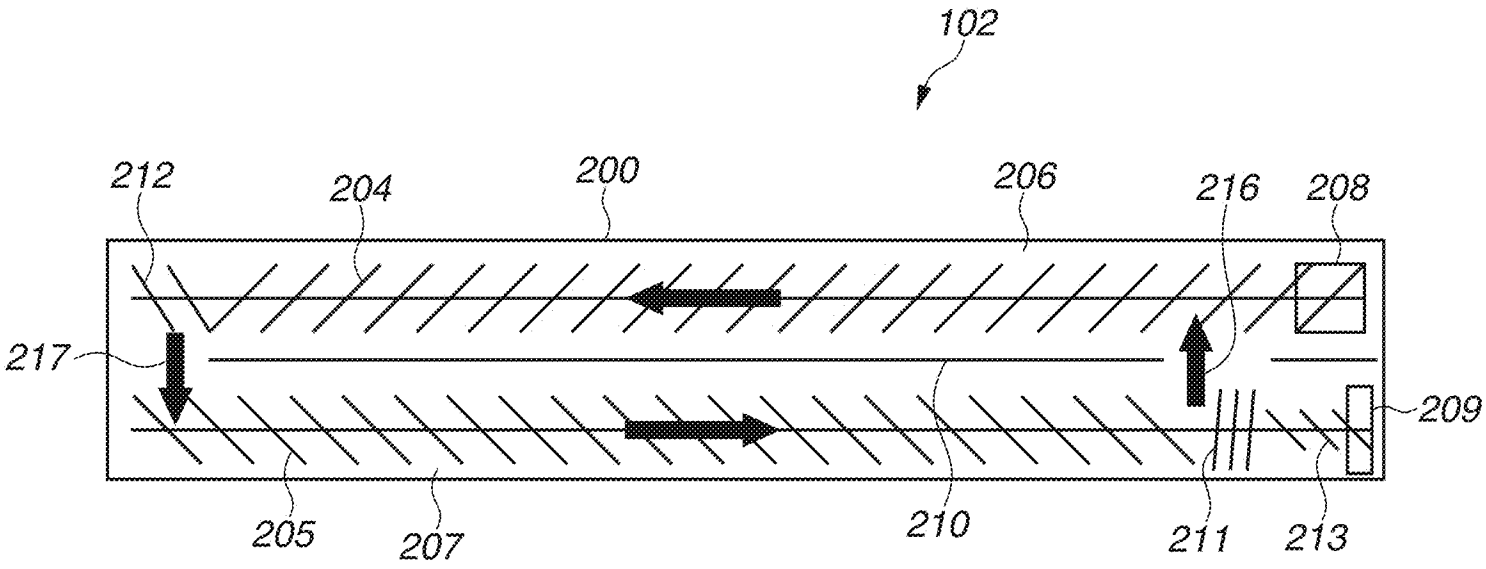
FIG. 4 is a schematic diagram illustrating a structure of a development device according to a first exemplary embodiment.

The structure of the development device 102 according to the first exemplary embodiment will be described below with reference to a schematic view illustrated in FIG. 4. In FIG. 4, components that are similar to those in FIGS. 2 and 3 are given the same reference numerals.

According to the first exemplary embodiment, the developer resupply opening 208 serving as the developer resupply portion for resupplying the developer to the developer container 200 is formed at a position 30 mm upstream of the most upstream portion of the agitation chamber 206 in the direction in which the second screw portion 204 conveys the developer.

Further, according to the first exemplary embodiment, a developer discharge opening 209 serving as a developer discharge portion for discharging a portion of the developer circulated between the agitation chamber 206 and the development chamber 207 from the developer container 200 is formed. According to the first exemplary embodiment, the developer discharge opening 209 is disposed downstream of the facing portion of the rotation shaft 205*a* that faces the first communication opening 216 in the direction in which the first screw portion 205 conveys the developer.

A tandem-type image forming apparatus includes four image forming units (image forming stations) respectively corresponding to Y, M, C, and Bk, so spaces between the respective image forming stations are limited. Therefore, in a tandem-type image forming apparatus, the developer discharge opening 209 is desirably disposed on the bottom surface side of the development device 102 where space is obtainable with ease instead of the side surface side of the development device 102 where space is limited. Thus, in the case where the image forming apparatus 120 is a tandem-type image forming apparatus, the developer discharge opening 209 is disposed on the bottom surface side of the development device 102 (i.e., bottom surface of the development chamber 207) which is disposed downstream of the facing portion of the rotation shaft 205*a* that faces the first communication opening 216 in the direction in which the first screw portion 205 conveys the developer.

Further, according to the first exemplary embodiment, the toner collection container for collecting waste toner is disposed at the front side of the image forming apparatus 120. Thus, in order to shorten a waste carrier conveyance path through which the developer (waste carrier) discharged from the developer discharge opening 209 is collected into the toner collection container, the developer discharge opening 209 is desirably disposed at a front side of the image forming apparatus 120 instead of a back side.

Further, according to the first exemplary embodiment, a discharge screw portion 213 is provided to the outer periphery of the rotation shaft 205*a* in the direction in which the first screw portion 205 conveys the developer, and conveys the developer contained in the development chamber 207 in the same direction as the direction in which the first screw portion 205 conveys the developer. According to the first exemplary embodiment, the discharge screw portion 213 is disposed downstream of the first returning screw portion 211 and upstream of the developer discharge opening 209.

Further, according to the first exemplary embodiment, a mixture of toner and a small amount of magnetic carrier is used as the developer (hereinafter, referred to as "developer for resupply") that is to be resupplied from the developer resupply container 130. For example, according to the first exemplary embodiment, a mixture of 90% toner and 10% magnetic carrier by weight with respect to the weight of the developer is used as the developer for resupply. Further, according to the first exemplary embodiment, the resupply of the developer to the developer container 200 is conducted if the weight percent of the toner contained in the developer circulated in the developer container 200 is below 8%.

Next, the movement of the developer to the developer discharge opening 209 will be described below.

The developer conveyed downstream in the direction in which the first screw portion 205 conveys the developer generates a flow of the developer toward the first communication opening 216 at a portion facing the first returning screw portion 211. At this time, a small amount of developer that is unsuccessfully returned by the first returning screw portion 211 and is conveyed beyond the first returning screw portion 211 is conveyed toward the developer discharge opening 209 by the discharge screw portion 213. Then, the developer having reached the developer discharge opening 209 is discharged to the outside of the developer container 200 by the gravity. The amount of developer that is conveyed beyond the first returning screw portion 211 varies depending on the amount of developer existing downstream in the direction in which the first screw portion 205 conveys the developer.

Specifically, when the amount of developer existing downstream in the direction in which the first screw portion 205 conveys the developer is small, the surface level of the developer existing downstream in the direction in which the first screw portion 205 conveys the developer is not high. Thus, if the amount of developer existing downstream in the direction in which the first screw portion 205 conveys the developer is small, the developer is not likely to be conveyed beyond the first returning screw portion 211, so that the developer is not discharged from the developer discharge opening 209. Accordingly, when the amount of developer in a circulation path circulating in the developer container 200 is not large, the developer is not discharged from the developer discharge opening 209, so that the developer will not be decreased but only increased by the developer for resupply that is resupplied from the developer resupply opening 208.

On the other hand, when the amount of developer existing downstream in the direction in which the first screw portion 205 conveys the developer is large, the surface level of the developer existing downstream in the direction in which the first screw portion 205 conveys the developer is high. Thus, the greater the amount of developer existing downstream in the direction in which the first screw portion 205 conveys the developer is, the more the developer is conveyed beyond the first returning screw portion 211 to increase the amount of developer discharged from the developer discharge opening 209.

Accordingly, even when the developer for resupply is continuously resupplied from the developer resupply opening 208, an increase in the amount of developer in the developer container 200 is stopped when the amount of developer resupplied to the developer container 200 and the amount of developer discharged from the developer container 200 are equal. Thus, the developer is prevented from increasing beyond the storage capacity of the developer container 200 and overflowing the developer container 200.

As described above, according to the first exemplary embodiment, the developer circulated between the agitation chamber 206 and the development chamber 207 is prevented from being excessively discharged from the developer discharge opening 209 in the function separation type development device including the developer discharge opening 209.

In the development device 102 according to the first exemplary embodiment, the force applied by the first returning screw portion 211 to convey the developer is set stronger than the force applied by the second returning screw portion 212 to convey the developer so that the amount of developer circulated between the agitation chamber 206 and the development chamber 207 can be kept within the predetermined in the function separation type development device including the developer discharge opening 209. Details thereof will be described below.

First, the definition of the returning capability of the returning screw portions will be described. In general, the speed at which a screw conveys a developer is proportional to the area of a blade portion which is obtained by subtracting the outer diameter of a rotation shaft from the diameter of the outer periphery of the screw, pitch of the blade portion, rotation speed, bulk density of the developer, and filling rate. However, if the pitch of the blade portion is excessively increased, the speed of conveying the developer can be decreased, because the increase of the pitch of the blade portion increases a contribution of the decrease in conveyance efficiency of the screw in the balance between an increase in the distance along which the developer is movable per rotation of the screw and the decrease in conveyance efficiency of the screw.

As a result of increasing the pitch of the blade portion, the angle of the blade portion with respect to the rotation shaft is changed from the vertical (90 degrees) toward the horizontal (0 degrees). For example, the angle of the blade portion with respect to the rotation shaft when the pitch of the blade portion is 30 mm is smaller than the angle of the blade portion with respect to the rotation shaft when the pitch of the blade portion is 15 mm. Thus, as a result of increasing the pitch of the blade portion, a component of the force which conveys the developer in the circumferential direction of the screw (i.e., force which scatters the developer) becomes more dominant than a component of the force which conveys the developer in the rotation axis direction of the screw (i.e., force which pushes the developer in the direction in which the developer is conveyed).

Thus, in order to increase the developer conveyance efficiency of the screw, the pitch of the blade portion should simply be reduced, because if the pitch of the blade portion is small, the developer is conveyed more reliably although the speed of conveying the developer is slow.

The returning capability Fs [g/sec] of the returning screw is defined by formula 1 below as the performance of the returning screw alone.

$$Fs=S\times(R^2-r^2)\times rs\times l/P,$$

where S [g·min/sec·m$^3$] is the proportionality constant, R [m] is the length of the outer periphery diameter of the returning screw portion, and r[m] is the length of the outer diameter of the rotation shaft of the returning screw portion. Further, rs [rpm] is the number of rotations of the returning screw portion, l [m] is the length of the returning screw portion in the longitudinal direction, and P [m] is the length of the pitch of the blade portion of the returning screw portion.

The returning capability Fs of the returning screw portion which is obtained by formula 1 of the returning capability physically indicates the amount of developer that can be pushed back in the opposite direction with respect to the developer conveyed toward the returning screw portion per unit time. A greater value of Fs indicates a higher returning capability of the returning screw.

In the development device 102 according to the first exemplary embodiment, the blade portion of the first returning screw portion 211 has a pitch of 3 [mm], forms a spiral structure around a screw shaft (rotation shaft 205*a*), and has an outer periphery diameter of 20 [mm], a shaft diameter of 6 [mm], and a length of 10 [mm] in the longitudinal direction. Further, the first returning screw portion 211 and the first screw portion 205 share the rotation shaft 205*a*, so the rotation speed of the first returning screw portion 211 is 800 [rpm].

Further, in the development device 102 according to the first exemplary embodiment, the blade portion of the second returning screw portion 212 has a pitch of 6 [mm], forms a spiral structure around a screw shaft (rotation shaft 204*a*), and has an outer periphery diameter of 20 [mm], a shaft diameter of 8 [mm], and a length of 10 [mm] in the longitudinal direction. Further, the second returning screw portion 212 and the second screw portion 204 share the rotation shaft 204*a*, so the rotation speed of the second returning screw portion 212 is 800 [rpm].

According to the first exemplary embodiment, the returning capability Fs2 of the second returning screw portion 212 which is obtained from formula 1 of the returning capability is Fs2=44.8S [g/sec], and the returning capability Fs1 of the first returning screw portion 211 is Fs1=97.1S [g/sec]. Specifically, according to the first exemplary embodiment, the relationship Fs1>Fs2 is satisfied.

When the amount of developer in the developer container 200 is below the predetermined amount, the first returning screw portion 211 needs to hold back all the developer conveyed toward the first returning screw portion 211 and pass the developer to the agitation chamber 206 in order to prevent the developer from being discharged from the developer discharge opening 209. Specifically, the first returning screw portion 211 plays the role of holding back the developer when the amount of developer in the developer container 200 is below the predetermined amount.

In the second returning screw portion 212, on the other hand, the upstream side in the returning direction is a dead end at the most downstream portion of the agitation chamber 206 (also referred to as "end portion of the agitation chamber 206"). Thus, even if the developer is conveyed beyond the second returning screw portion 212, the developer is held back at the most downstream portion of the agitation chamber 206 and is then passed from the agitation chamber 206 to the development chamber 207 through the second communication opening 217. Specifically, the second returning screw portion 212 plays the role of returning the developer held back and accumulated at the most downstream portion of the agitation chamber 206 into the circulation path circulating between the agitation chamber 206 and the development chamber 207.

Thus, when, for example, Fs1<Fs2=44.8S [g/sec], the returning capability of the first returning screw portion 211 is so low that the developer is excessively discharged through the developer discharge opening 209 to the outside of the developer container 200. Further, when, for example, Fs2>Fs1=97.1S [g/sec], the returning capability of the second returning screw portion 212 is too high. When the returning capability of the second returning screw portion 212 is too high, there is no developer in the space between the most downstream portion of the second returning screw portion 212 and the most downstream portion of the agitation chamber 206 in the direction in which the second screw portion 204 conveys the developer, so the space is wasted.

Accordingly, the returning capabilities of the returning screw portions are desirably such that the returning capability Fs1 of the first returning screw portion 211 is greater than the returning capability Fs2 of the second returning screw portion 212. The returning capability Fs1 of the first returning screw portion 211 indicates the strength of the force applied by the first returning screw portion 211 to convey the developer. Further, the returning capability Fs2 of the second returning screw portion 212 indicates the strength of the force applied by the second returning screw portion 212 to convey the developer.

While the function separation type development device in which the areas and pitches of the screw portions of the first returning screw portion 211 and the second returning screw portion 212 are set different so that the relationship Fs1>Fs2 is satisfied has been described as an example in the first exemplary embodiment, this is not a limiting example. According to a modified example, the lengths of the screw portions of the first returning screw portion 211 and the second returning screw portion 212 in the longitudinal direction can be set different to satisfy the relationship Fs1>Fs2 according to formula 1 of the returning capability described above. According to another modified example, the number of rotations of the returning screw portions of the first returning screw portion 211 and the second returning screw portion 212 can be set different according to formula 1 of the returning capability to satisfy the relationship Fs1>Fs2. The number of rotations of the first screw portion 205 and the second screw portion 204 can be set different by separating the first screw portion 205 and the second screw portion 204.

As described above, according to the first exemplary embodiment, the developer discharge opening 209 is disposed downstream in the direction in which the development chamber 207 conveys the developer in the function separation type development device. In this way, the developer circulated between the agitation chamber 206 and the development chamber 207 is prevented from being excessively discharged from the developer discharge opening 209 in the function separation type development device including the developer discharge opening 209.

Further, according to the first exemplary embodiment, the returning capability Fs1 of the first returning screw portion 211 is set higher than the returning capability Fs2 of the second returning screw portion 212 in the function separation type development device. In this way, the amount of developer circulated between the agitation chamber 206 and the development chamber 207 is maintained within the predetermined amount in the function separation type development device including the developer discharge opening 209.

Figure 5:
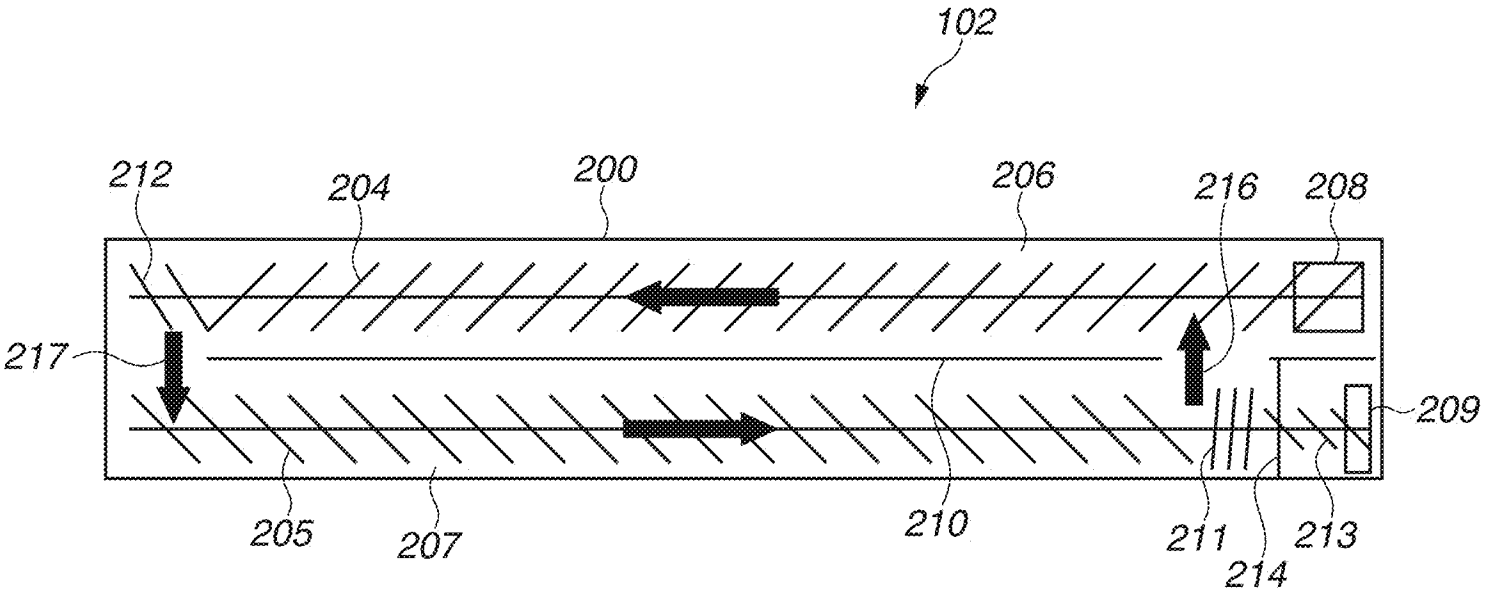
FIG. 5 is a schematic diagram illustrating a structure of a development device according to a second exemplary embodiment.

The structure of the development device 102 according to a second exemplary embodiment will be described below with reference to a schematic view illustrated in FIG. 5. In FIG. 5, components that are similar to those in FIG. 4 are denoted by the same reference numerals.

In the development device 102 according to the second exemplary embodiment, a wall member 214 is provided downstream of the first returning screw portion 211 in the direction in which the first screw portion 205 conveys the developer. In other words, the wall member 214 is provided upstream of the first returning screw portion 211 in the direction in which the first returning screw portion 211 conveys the developer. Accordingly, the development device 102 according to the second exemplary embodiment is different from the first exemplary embodiment in that the wall member 214 is provided between the first returning screw portion 211 and the developer discharge opening 209, as illustrated in FIG. 5.

Figure 6A:
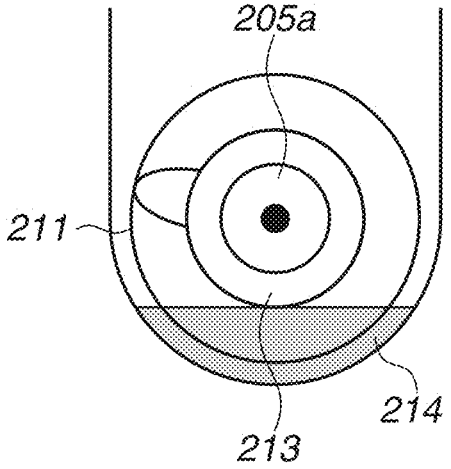
FIGS. 6A and 6B are cross sectional views illustrating a structure of a wall member.
Figure 6B:
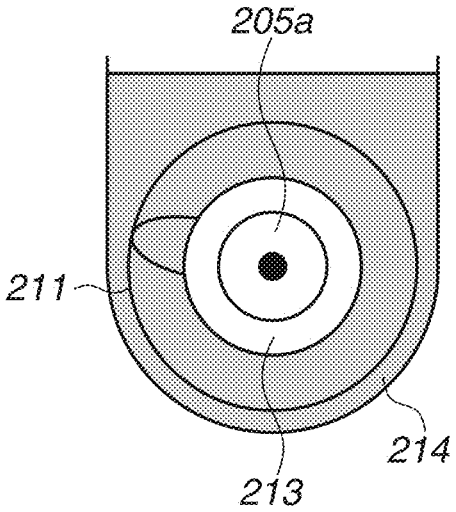

FIGS. 6A and 6B are cross sectional views each illustrating the wall member 214 along a cross section that is orthogonal to the rotation axis of the first returning screw portion 211.

As illustrated in FIG. 6A, the height from the bottom surface of the developer container 200 to the wall member 214 reaches the rotation shaft 205*a* of the first screw portion 205 from the developer container 200. Thus, some of the developer that is unsuccessfully held back by the first returning screw portion 211 can be held back by the wall member 214. Specifically, the wall member 214 is a regulation member which regulates the amount of developer conveyed toward the developer discharge opening 209.

According to the second exemplary embodiment, by providing the wall member 214, the returning capability Fs1 of the first returning screw portion 211 can be set lower than that according to the first exemplary embodiment. If the returning capability Fs1 of the first returning screw portion 211 can be set low, for example, the length of the first returning screw portion 211 can be shortened, so that the length of the development device 102 in the longitudinal direction is shortened to reduce the size of the development device 102.

However, the cross-sectional area of the wall member 214 is smaller than the cross-sectional area of the end portion of the developer container 200 (end portion of the development chamber 207) in the direction in which the developer is conveyed in the development chamber 207, so the capability of holding back the developer is low. Thus, even if the returning capability Fs1 of the first returning screw portion 211 is to be set low, the strength of the returning capability Fs1 of the first returning screw portion 211 needs to be set greater than the strength of the returning capability Fs2 of the second returning screw portion 212.

As to the shape of the wall member 214, the wall member 214 with an opening along the outer diameter of the discharge screw portion 213 as illustrated in FIG. 6B can be used. The wall member 214 illustrated in FIG. 6B substantially blocks the entire portion of the cross section of the end portion of the developer container 200 (end portion of the development chamber 207) excluding the discharge screw portion 213, so that the effect of holding back the developer is increased, compared to the wall member 214 illustrated in FIG. 6A.

It should be noted that the exemplary embodiments described above are not intended to limit the scope of the invention, and various modifications (including organic combinations of the exemplary embodiments) within the spirit of the invention are possible and are not to be excluded from the scope of the invention.

While the function separation type development devices in which the development sleeve 201 is rotated in the direction of the arrow b and the development blade 203 is disposed below the development sleeve 201 as illustrated in FIG. 2 have been described as examples in the above exemplary embodiments, application of an exemplary embodiment of the present invention is not limited to the examples. An exemplary embodiment of the present invention is also applicable to a function separation type development device in which the development sleeve 201 is rotated in the opposite direction to the direction of the arrow b and the development blade 203 is disposed above the development sleeve 201.

Further, while the function separation type development devices in which the developer resupply opening 208 is formed 30 mm upstream of the upstream end portion of the agitation chamber 206 as illustrated in FIG. 4 have been described as examples in the above exemplary embodiments, application of an exemplary embodiment of the present invention is not limited to the examples. According to a modified example, the developer resupply opening 208 can be formed upstream of the most downstream portion of the facing portion of the agitation chamber 206 that faces the first communication opening 216 and downstream of the most upstream portion of the facing portion in the direction in which the second screw portion 204 conveys the developer. For example, the developer resupply opening 208 is formed from a point disposed 0 mm to 10 mm upstream of the most downstream portion of the facing portion of the agitation chamber 206 that faces the first communication opening 216 in the direction in which the second screw portion 204 conveys the developer, and the developer resupply opening 208 is formed to overlap the facing portion. In a case where the toner (toner not being charged) resupplied from the developer resupply opening 208 can be agitated sufficiently with the developer in the path circulating between the agitation chamber 206 and the development chamber 207, the position of the developer resupply opening 208 with respect to the circulation path is not limited.

Further, while the function separation type development devices in which the discharge screw portion 213 is provided between the first returning screw portion 211 and the developer discharge opening 209 as illustrated in FIG. 4 have been described as examples in the above exemplary embodiments, application of an exemplary embodiment of the present invention is not limited to the examples. According to a modified example, in a case where the distances between the developer discharge opening 209 and the first returning screw portion 211 and the developer discharge opening 209 are small, the discharge screw portion 213 is not essential, and the developer discharge opening 209 can be omitted.

Further, while the function separation type development devices including the first returning screw portion 211 and the second returning screw portion 212 as illustrated in FIG. 4 have been described as examples in the above exemplary embodiments, application of an exemplary embodiment of the present invention is not limited to the examples. According to a modified example, if the developer can be passed smoothly from the development chamber 207 to the agitation chamber 206 through the first communication opening 216, the first returning screw portion 211 is not essential, and the first returning screw portion 211 can be omitted. According to another modified example, if the developer can be passed smoothly from the agitation chamber 206 to the development chamber 207 through the second communication opening 217, the second returning screw portion 212 is not essential, and the second returning screw portion 212 can be omitted.

While aspects of the present invention have been described with reference to exemplary embodiments, it is to be understood that aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2016-218862, filed Nov. 9, 2016, which is hereby incorporated by reference herein in its entirety.

What is claimed is:

1. A development device comprising:

a developer bearing member provided rotatably and configured to bear developer including toner and carrier to convey the developer to a development region facing an image bearing member;

a first chamber configured to supply the developer to the developer bearing member;

a second chamber configured to collect the developer having passed through the development region from the developer bearing member;

a first communication portion configured to permit movement of the developer from the second chamber to the first chamber;

a second communication portion configured to permit movement of the developer from the first chamber to the second chamber;

a first conveyance screw disposed in the first chamber and configured to convey the developer in a first direction from the first communication portion toward the second communication portion, the first conveyance screw being disposed below the developer bearing member when the development device develops an electrostatic latent image formed on the image bearing member;

a second conveyance screw disposed in the second chamber and configured to convey the developer in a second direction from the second communication portion toward the first communication portion;

a partition wall configured to partition the first chamber and the second chamber;

a guiding surface provided on the partition wall and configured to guide collecting the developer having passed through the development region from the developer bearing member to the second chamber;

a developer replenish portion configured to replenish the developer; and a developer discharge portion configured to discharge a part of the developer as the developer is replenished by the developer replenish portion, wherein the developer discharge portion is provided on a bottom portion of the first chamber which is disposed downstream of the second communication portion with respect to the first direction.

2. The development device according to claim 1, wherein the development device is attached to an image forming apparatus configured to form an image on a recording material, and wherein the developer discharge portion is disposed on a front side of the image forming apparatus.

3. The development device according to claim 1, wherein the development device is attached to an image forming apparatus configured to form an image on a recording material, the image forming apparatus including a collection container provided so as to be attachable to and detachable from the image forming apparatus and configured to collect the toner removed from the image bearing member, and wherein the developer discharge portion is disposed on the same side of the image forming apparatus as a side of the image forming apparatus on which the collection container is disposed.

4. The development device according to claim 1, further comprising a damming member disposed in the first chamber, provided downstream of the second communication portion with respect to the first direction, and configured to dam a part of the developer conveyed toward the developer discharge portion, wherein the developer discharge portion is provided on the bottom portion of the first chamber which is disposed downstream of the damming member with respect to the first direction.

5. The development device according to claim 1, wherein the first conveyance screw includes:

a first blade portion configured to convey the developer in the first chamber in the first direction, and a second blade portion which is disposed downstream of the first blade portion with respect to the first direction and configured to convey the developer in the first chamber in the second direction and communicate the developer to the second chamber via the second communication portion, and wherein the developer discharge portion is provided on the bottom portion of the first chamber which is disposed downstream of the second blade portion with respect to the first direction.

6. The development device according to claim 1, wherein the guiding surface is provided on the partition wall such that the developer having passed through the development region is able to be collected by the second chamber without passing through the first chamber from the developer bearing member.

7. A development device comprising:

a developer bearing member provided rotatably and configured to bear developer including toner and carrier to convey the developer to a development region facing an image bearing member;

a first chamber configured to supply the developer to the developer bearing member;

a second chamber configured to collect the developer having passed through the development region from the developer bearing member;

a first communication portion configured to permit movement of the developer from the second chamber to the first chamber;

a second communication portion configured to permit movement of the developer from the first chamber to the second chamber;

a first conveyance screw disposed in the first chamber and configured to convey the developer in a first direction from the first communication portion toward the second communication portion, the first conveyance screw being disposed below the developer bearing member when the development device develops an electrostatic latent image formed on the image bearing member;

a second conveyance screw disposed in the second chamber and configured to convey the developer in a second direction from the second communication portion toward the first communication portion;

a partition wall configured to partition the first chamber and the second chamber;

a guiding surface provided on the partition wall and configured to guide collecting the developer having passed through the development region from the developer bearing member to the second chamber;

a developer replenish portion configured to replenish the developer; and a developer discharge portion configured to discharge a part of the developer as the developer is replenished by the developer replenish portion, wherein the developer discharge portion is provided on the first chamber which is disposed downstream of the second communication portion with respect to the first direction.

8. The development device according to claim 7, wherein the guiding surface is provided on the partition wall such that the developer having passed through the development region is able to be collected by the second chamber without passing through the first chamber from the developer bearing member.

9. The development device according to claim 7, wherein the first conveyance screw includes:

a first blade portion configured to convey the developer in the first chamber in the first direction, and a second blade portion which is disposed downstream of the first blade portion with respect to the first direction and configured to convey the developer in the first chamber in the second direction and communicate the developer to the second chamber via the second communication portion, and wherein the developer discharge portion is provided on the first chamber which is disposed downstream of the second blade portion with respect to the first direction.

10. The development device according to claim 7, further comprising a damming member disposed in the first chamber, provided downstream of the second communication portion with respect to the first direction, and configured to dam a part of the developer conveyed toward the developer discharge portion, wherein the developer discharge portion is provided on the first chamber which is disposed downstream of the damming member with respect to the first direction.

11. The development device according to claim 7, wherein the development device is attached to an image forming apparatus configured to form an image on a recording material, and wherein the developer discharge portion is disposed on a front side of the image forming apparatus.

12. The development device according to claim 7, wherein the development device is attached to an image forming apparatus configured to form an image on a recording material, the image forming apparatus including a collection container provided so as to be attachable to and detachable from the image forming apparatus and configured to collect the toner removed from the image bearing member, and wherein the developer discharge portion is disposed on the same side of the image forming apparatus as a side of the image forming apparatus on which the collection container is disposed.

13. A development device comprising:

a developer bearing member provided rotatably and configured to bear developer including toner and carrier to convey the developer to a development region facing an image bearing member;

a first chamber configured to supply the developer to the developer bearing member;

a second chamber configured to collect the developer having passed through the development region from the developer bearing member;

a first communication portion configured to permit movement of the developer from the second chamber to the first chamber;

a second communication portion configured to permit movement of the developer from the first chamber to the second chamber;

a first conveyance screw disposed in the first chamber and configured to convey the developer in a first direction from the first communication portion toward the second communication portion, the first conveyance screw being disposed below the developer bearing member when the development device develops an electrostatic latent image formed on the image bearing member;

a second conveyance screw disposed in the second chamber and configured to convey the developer in a second direction from the second communication portion toward the first communication portion;

a partition portion configured to partition the first chamber and the second chamber, the partition portion extending to the vicinity of the developer bearing member;

a developer replenish portion configured to replenish the developer; and a developer discharge portion configured to discharge a part of the developer as the developer is replenished by the developer replenish portion, wherein the developer discharge portion is provided on the first chamber which is disposed downstream of the second communication portion with respect to the first direction.

14. The development device according to claim 13, further comprising a magnet fixed inside of the developer bearing member, including a first pole, and a second pole disposed, downstream of the first pole with respect to the rotational direction of the developer bearing member, adjacent to the first pole and having the same polarity as the first pole, and configured to generate a repulsive magnetic field for removing the developer having passed through the development region from the developer bearing member, wherein the position of the partition portion closest to the developer bearing member is in the region of the repulsive magnetic field generated by the magnet.

15. The development device according to claim 13, wherein the partition portion extends to the vicinity of the developer bearing member such that the developer having passes through the development region is able to be collected by the second chamber without passing through the first chamber from the developer bearing member.

16. The development device according to claim 13, wherein the first conveyance screw includes:

a first blade portion configured to convey the developer in the first chamber in the first direction, and a second blade portion which is disposed downstream of the first blade portion with respect to the first direction and configured to convey the developer in the first chamber in the second direction and communicate the developer to the second chamber via the second communication portion, and wherein the developer discharge portion is provided on the first chamber which is disposed downstream of the second blade portion with respect to the first direction.

17. The development device according to claim 13, further comprising a damming member disposed in the first chamber, provided downstream of the second communication portion with respect to the first direction, and configured to dam a part of the developer conveyed toward the developer discharge portion, wherein the developer discharge portion is provided on the first chamber which is disposed downstream of the damming member with respect to the first direction.

18. The development device according to claim 13, wherein the development device is attached to an image forming apparatus configured to form an image on a recording material, and wherein the developer discharge portion is disposed on a front side of the image forming apparatus.

19. The development device according to claim 13, wherein the development device is attached to an image forming apparatus configured to form an image on a recording material, the image forming apparatus including a collection container provided so as to be attachable to and detachable from the image forming apparatus and configured to collect the toner removed from the image bearing member, and wherein the developer discharge portion is disposed on the same side of the image forming apparatus as a side of the image forming apparatus on which the collection container is disposed.

20. A development device comprising:

a developer bearing member provided rotatably and configured to bear developer including toner and carrier to convey the developer to a development region facing an image bearing member;

a first chamber configured to supply the developer to the developer bearing member;

a second chamber configured to collect the developer having passed through the development region from the developer bearing member;

a first communication portion configured to permit movement of the developer from the second chamber to the first chamber;

a second communication portion configured to permit movement of the developer from the first chamber to the second chamber;

a first conveyance screw disposed in the first chamber and configured to convey the developer in a first direction from the first communication portion toward the second communication portion, the first conveyance screw being disposed below the developer bearing member when the development device develops an electrostatic latent image formed on the image bearing member;

a second conveyance screw disposed in the second chamber and configured to convey the developer in a second direction from the second communication portion toward the first communication portion;

a partition portion configured to partition the first chamber and the second chamber, the partition portion is provided such that the developer having passes through the development region is able to be collected by the second chamber without passing through the first chamber from the developer bearing member;

a developer replenish portion configured to replenish the developer; and a developer discharge portion configured to discharge a part of the developer as the developer is replenished by the developer replenish portion, wherein the developer discharge portion is provided on the first chamber which is disposed downstream of the second communication portion with respect to the first direction.

21. The development device according to claim 20, wherein the first conveyance screw includes:

a first blade portion configured to convey the developer in the first chamber in the first direction, and a second blade portion which is disposed downstream of the first blade portion with respect to the first direction and configured to convey the developer in the first chamber in the second direction and communicate the developer to the second chamber via the second communication portion, and wherein the developer discharge portion is provided on the first chamber which is disposed downstream of the second blade portion with respect to the first direction.

22. The development device according to claim 20, further comprising a damming member disposed in the first chamber, provided downstream of the second communication portion with respect to the first direction, and configured to dam a part of the developer conveyed toward the developer discharge portion, wherein the developer discharge portion is provided on the first chamber which is disposed downstream of the damming member with respect to the first direction.

23. The development device according to claim 20, wherein the development device is attached to an image forming apparatus configured to form an image on a recording material, and wherein the developer discharge portion is disposed on a front side of the image forming apparatus.

24. The development device according to claim 20, wherein the development device is attached to an image forming apparatus configured to form an image on a recording material, the image forming apparatus including a collection container provided so as to be attachable to and detachable from the image forming apparatus and configured to collect the toner removed from the image bearing member, and wherein the developer discharge portion is disposed on the same side of the image forming apparatus as a side of the image forming apparatus on which the collection container is disposed.

* * * * *